US008960313B2

(12) United States Patent
Dyer et al.

(10) Patent No.: US 8,960,313 B2
(45) Date of Patent: Feb. 24, 2015

(54) PACKER DEPLOYED FORMATION SENSOR

(75) Inventors: Stephen Dyer, Al-Khobar (SA); Muhammad Shafiq, Al-Khobar (SA); Michael Allen, Insch (GB); Nitin Y. Vaidya, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 250 days.

(21) Appl. No.: 13/043,711

(22) Filed: Mar. 9, 2011

(65) Prior Publication Data

US 2012/0175135 A1 Jul. 12, 2012

Related U.S. Application Data

(60) Provisional application No. 61/313,952, filed on Mar. 15, 2010.

(51) Int. Cl.

| | |
|---|---|
| ***E21B 23/06*** | (2006.01) |
| ***E21B 47/00*** | (2012.01) |
| ***E21B 33/12*** | (2006.01) |
| ***E21B 47/01*** | (2012.01) |
| ***E21B 33/127*** | (2006.01) |

(52) U.S. Cl.

CPC ..... *E21B 47/01* (2013.01); *E21B 33/1208* (2013.01); *E21B 33/127* (2013.01)

USPC ..... 166/387; 166/250.17; 166/66

(58) Field of Classification Search

USPC ..... 166/387, 250.17, 66, 118

See application file for complete search history.

(56) References Cited

U.S. PATENT DOCUMENTS

| | | | | |
|---|---|---|---|---|
| 5,353,873 | A | 10/1994 | Cooke, Jr. | |
| 7,337,850 | B2 | 3/2008 | Contant | |
| 7,431,098 | B2 | 10/2008 | Ohmer | |
| 7,665,537 | B2 | 2/2010 | Patel et al. | |
| 2004/0112597 | A1* | 6/2004 | Hamid et al. | 166/250.17 |
| 2004/0173363 | A1 | 9/2004 | Navarro-Sorroche | |
| 2005/0199401 | A1* | 9/2005 | Patel et al. | 166/387 |
| 2006/0131029 | A1 | 6/2006 | Zupanick | |
| 2007/0151724 | A1* | 7/2007 | Ohmer et al. | 166/187 |
| 2007/0215345 | A1* | 9/2007 | Lafferty et al. | 166/250.1 |
| 2008/0185144 | A1* | 8/2008 | Lovell | 166/250.17 |
| 2010/0212891 | A1* | 8/2010 | Stewart et al. | 166/250.12 |

FOREIGN PATENT DOCUMENTS

| | | | |
|---|---|---|---|
| GB | 2443724 | A | 5/2008 |

OTHER PUBLICATIONS

PCT/US2011/027833—International Search Report and Written Opinion of the ISA dated Oct. 21, 2011.

* cited by examiner

*Primary Examiner* — Catherine Loikith

(74) *Attorney, Agent, or Firm* — Brandon Clark; David J. Groesbeck

(57) ABSTRACT

A packer deployed well wall monitoring or transceiver assembly. The assembly may be particularly suited for use with swellable packers wherein the sensor or transceiver is delivered in a manner that substantially avoids damage thereto. Furthermore, the pre-deployment configuration of the assembly may enhance the deployment and reliability of the sensor in terms of formation monitoring over time. The deployment of the packer provides the energy required for the sensor or transceiver to contact the well wall. The packer elastomeric material provides or can be enhanced to provide isolation of the sensor or transceivers from extraneous borehole disturbances improving their signal to noise characteristics.

5 Claims, 6 Drawing Sheets

PACKER DEPLOYED FORMATION SENSOR

PRIORITY CLAIM/CROSS-REFERENCE TO RELATED APPLICATION(S)

This Patent Document claims priority under 35 U.S.C. §119 to U.S. Provisional App. Ser. No. 61/313,952, filed on Mar. 15, 2010, and entitled, "Packer Deployed Formation Sensor", incorporated herein by reference in its entirety.

FIELD

Embodiments described relate to sensors for use in conjunction with downhole operations. In particular, sensors for incorporation into downhole completion equipment, specifically at downhole packers, are detailed. Such sensors may be utilized in open-hole or cased hole environments and are particularly well suited for acquisition of well wall and formation characteristics.

BACKGROUND

Exploring, drilling and completing hydrocarbon and other wells are generally complicated, time consuming, and ultimately very expensive endeavors. As a result, over the years, a significant amount of added emphasis has been placed on well monitoring and maintenance. Careful attention to design, monitoring and maintenance may help maximize production and extend well life. Thus, a substantial return on the investment in the completed well may be better ensured.

Monitoring well conditions may be undertaken by way of running a logging application. That is to say, logging to determine well pressures, temperatures, flow rates and other profile characteristics may be undertaken over the course of the life of the well, and not just prior to well completions. However, such follow-on logging comes with considerable costs. For example, in order to run such applications, the well may be shut down and other applications put on hold for several hours, if not days, while the logging application is run. Depending on the particular well and operations suspended for the logging, this may translate into tens to hundreds of thousands of dollars in added costs, particularly when factoring in lost production time.

Due to the high costs associated with follow-on logging as described above, ongoing monitoring of well conditions is often attempted through the use of downhole structure that is already present in the well. For example, pressure, temperature and other sensors may be incorporated into the sidewalls of completions tubulars. These sensors may be communicatively tethered to surface equipment via a line running along and supported by the tubular structure. Thus, data acquired by the sensors may be relayed to the surface equipment for ongoing monitoring of downhole well conditions.

Unfortunately, depending of the type of monitoring to be conducted, tubular mounting of sensors may place significant limitations on the quality of the data obtained. So, for example, flow and resistivity sensors may provide workable data when outfitted at a tubular wall. On the other hand, where the sensor is an acoustic sensor, for example, directed at the formation defining the well, it is unlikely that disposing the sensor at the tubular will result in obtaining any usable formation data. That is, acoustic noise through the tubular and/or downhole fluid flow through the annular space between the tubular and the formation may be quite significant. Thus, the signal to noise ratio acquired by the sensor is unlikely to result in workable data as such relates to the formation. Indeed, such signal to noise ratio issues may present for pressure, electrical, electromagnetic and a variety of other sensor types.

In some cases, where obtaining formation characteristic data is paramount, a subsequent interventional application directed specifically at the formation may be undertaken due to the unavailability of reliable data from a tubular disposed sensor. However, as with the follow-on logging application described above, this may come at significant added costs.

Furthermore, in some cases, the amount of formation characteristic data that is sought across the oilfield is of such significance to operations that cross-well, borehole to surface or surface to borehole logging is undertaken. Cross-well logging involves the acquisition of formation data from multiple wells throughout the oilfield, typically using a source such as a well, surface or shallow dedicated "subsurface" transmitter deployment, with an observation well, surface or dedicated "subsurface" sensor deployment. These methods typically provide a two dimensional plane of information, such as resistivity, between the source and receiver locations. As such, formation characteristics between wells and throughout the oilfield may be better established. Distributing suitable sensors or transceivers into otherwise producing or injecting wells, affords a more comprehensive distribution of detection or transmission "locations" allowing multiple planes of information to be determined, improving areal and vertical coverage of the information.

Of course, formation logging of multiple wells drives up the cost of operations dramatically. That is to say, the interruption and added interventional efforts of follow-on logging are now multiplied. Unfortunately, so are the costs. Due to the added costs associated with follow-on logging, well monitoring often remains limited to that which may be acquired from completions tubular disposed sensors. This may come with sacrifice to the quality of the acquired data, particularly in the case of data sought to be acquired from the formation itself. At present, alternative options for acquisition of such formation data is limited to those options that that are accompanied by the noted dramatic increase in operational costs.

SUMMARY

A packer assembly for disposal in a well at an oilfield. The assembly includes a packer disposed about a tubular and is equipped with either of a sensor or transmitter at an outer surface thereof. A telemetric line is coupled to the sensor or transmitter as the case may be and run to a surface of the oilfield.

DETAILED DESCRIPTION

Embodiments herein are described with reference to certain types of sensor-packer assemblies. For example, these embodiments focus on swellable packer assemblies. However, a variety of alternative device deployments for delivery of downhole sensors may be utilized which are not limited to swellable packer embodiments. Similarly, the assemblies are shown disposed in open-hole environments for formation related data acquisition. However, in other embodiments, such assemblies may be utilized in cased hole environments. Further, the data acquisition involved may be directed at downhole conditions aside from formation characteristics. Regardless, embodiments detailed herein utilize packer deployed sensor and/or transmitter assemblies that are brought into proximity with a well wall for sensing and/or transmitting thereat, as the case may be.

Figure 1:
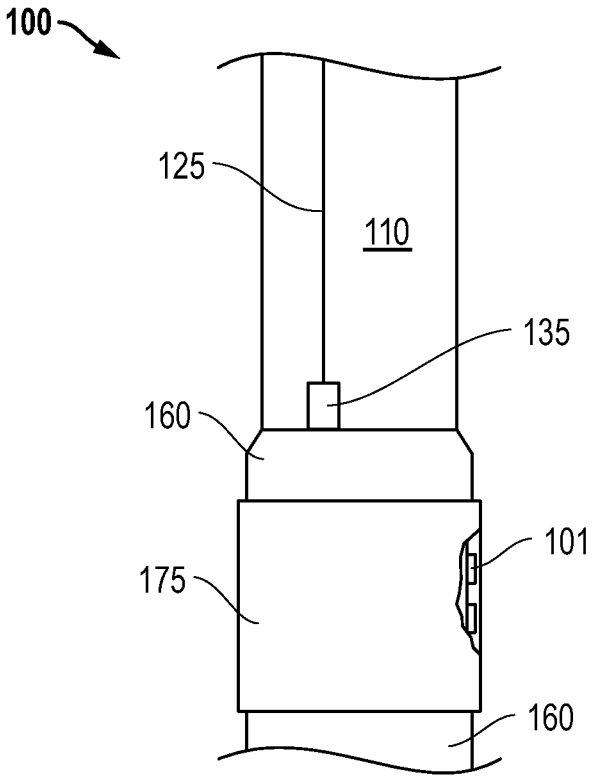
FIG. 1 is a front, partially-sectional view of an embodiment of a packer deployed sensor assembly.

Referring now to FIG. 1, a front, partially-sectional view of an embodiment of a packer deployed sensor assembly 100 is depicted. The assembly 100 includes a packer 160 that is disposed about a production tubular 110. However, in other embodiments, a variety of tubular, basepipe, mandrel or other under-support structure may be employed, depending upon the particular nature of downhole operations. The assembly 100 also includes a protective jacket 175 about a sensor 101. That is, the sensor 101 may be disposed at the outer surface of the packer 160 and covered by a protective jacket 175 as detailed further below. In one embodiment the packer 160 is of a swell variety employing a conventional swellable elastomer suitable for providing downhole isolations as well as delivering the sensor 101 toward a well wall as noted below. However, in other embodiments, mechanical or other packer varieties may be utilized.

The above described protective jacket 175 may be of a polymeric or metallic material configured to protect the sensor 101 during advancement of the assembly 100 through a downhole environment, prior to packer deployment. As detailed below, the jacket 175 may be configured for removal or dissolution once the packer 160 reaches a downhole target location for deployment. In a dissolvable metal-based embodiment, the jacket 175 may incorporate some variety of calcium, aluminum, zinc and/or magnesium. Regardless, whether metal-based or elastomeric, a conventional chemical slug of acid or solvent may be utilized to degrade the jacket 175 or, in an alternate embodiment, downhole conditions alone may be sufficient to adequately degrade the jacket 175.

Figure 2:
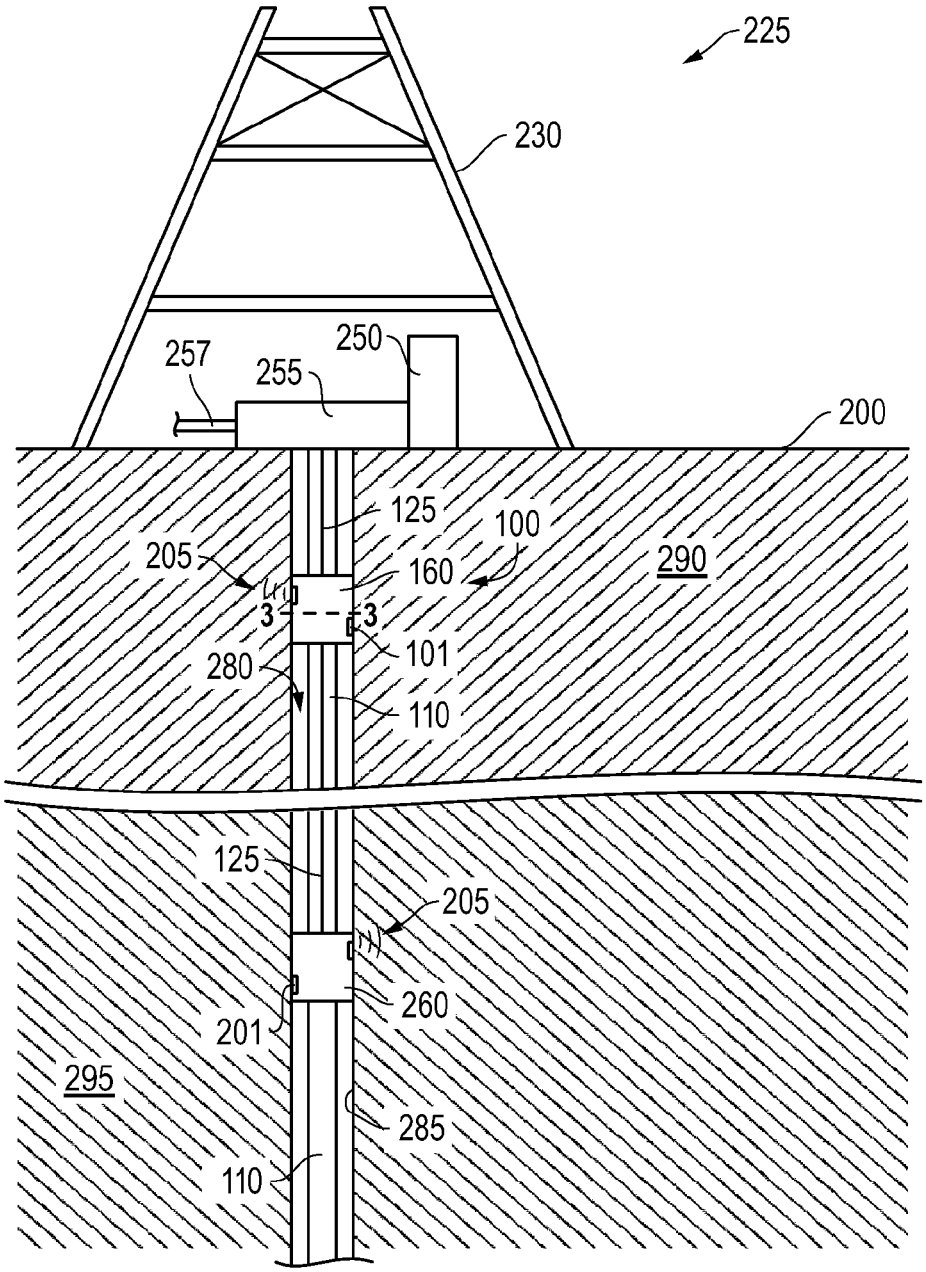
FIG. 2 is an overview of an oilfield having a well accommodating a sensor system which incorporates the assembly of FIG. 1.

With added reference to FIG. 2, the noted sensor 101 may be one of several that are disposed at the outer surface of the packer 160. Indeed, in the depiction of FIG. 1, multiple sensors 101 are visible. As detailed further below, the sensors 101 are configured for deployment by the packer 160 for secure positioning at a well wall 285. Thus, in certain embodiments the sensors 101 may be tailored to acquire wall 285 or formation 290, 295 data. However, in other embodiments, other information may be targeted. Furthermore, in some embodiments, the sensors 101 may serve as transceivers configured for transmissions 205 toward the wall 285 and formation 290, 295 in addition to sensing capacity. Indeed, in yet other embodiments, a sensor may actually be entirely substituted with a device serving solely as a transmitter. For example, this may be the case where an acoustic transmitter is provided and another sensor 101 is also provided to acquire downhole acoustic transmissions.

In all, sensors 101 (or transceivers) may be disposed as depicted in FIG. 1 for data acquisitions ranging from pressure, temperature, resistivity, hydrophone, vibration, acoustic, geophone, streaming potential, multiple axis accelerometer, strain, electromagnetic, magnetic, acidity, dipole, capacitance, dielectric, chemical detection including carbon dioxide, and a host of others. Transmitters (or transceivers) may similarly be geared toward emissions of an electromagnetic, acoustic, electrical dipole, vibrator, or sonic nature.

Data acquired by these sensors 101 may be telemetrically conveyed over a line 125 running therefrom. Indeed, the line 125 may be electric, hydraulic, fiber optic, or other suitable line for conveyance of data and/or power to or from the sensor 101. That is, this line 125 may run uphole from the assembly 100 toward surface equipment 225 at the surface of an oilfield 200 as detailed with respect to FIG. 2 below. Thus, analysis of detected data may be performed and, for example, in the case of transmitter or transceiver use, control over emissions may be directed from surface.

In the embodiment shown, an electronic subassembly 135 is positioned between the line 125 and the sensors 101. As such, processing or control interface may be afforded between the noted surface equipment 225 and the sensors 101. That is to say, data acquired by a sensor 101 may be processed prior to directing uphole over the line 125. Further, the connection between the sensor 101 and the subassembly 135 may be hard wired or wireless in nature for communication of data and/or power therebetween. The subassembly 135 may be of particular benefit where the line 125 is of the fiber optic variety, in which the subassembly 135 serves as an interface to translate electronic data transmissions into light signal for transmission over the line 125.

Referring now to FIG. 2, an overview of an oilfield 200 is shown. A well 280 which accommodates a sensor system incorporating the assembly 100 of FIG. 1 is itself accommodated at the oilfield 200. In the embodiment shown, the well 280 is open-hole in nature with deployed packers 160, 260 making contact with a well wall 285 that is defined by the formation 290, 295 itself. Thus, as detailed below, sensors 101, 201 may be forced into direct contact with the formation 290, 295. However, in other embodiments, the system may be deployed and utilized within a cased-hole environment. Regardless, where such a swelling deployment of the sensors 101, 201 is utilized, the possibility of shock damage thereto over the course of deployment is reduced.

In the embodiment shown, the packers 160, 260 are of a swellable configuration as noted above, resulting in forcibly holding the sensors 101, 201 in position at the well wall 285. The elastomeric material employed for such configurations may be selected to enhance isolation of the sensors 101, 201 at the wall 285. Thus, the signal to noise ratio may similarly be enhanced for sensor detections directed at the wall 285. That is to say, the detection of stray noise, pressure, electrical conductivity, vibration or other misleading disturbances may be minimized, thereby improving the quality of the detections acquired by the sensors 101, 201.

The well 280 is shown traversing various formation layers 290, 295 with a packer 160, 260 disposed in each. Thus, the above noted sensors 101, 201 may be disposed at locations that allow data acquisition relative each layer 290, 295. Alternatively, as noted above, the sensors 101, 201 may be transceivers or transmitters that allow for transmissions into the formation layers 290, 295 (see 205). These transmissions may be sonic, electromagnetic arrays or of other varieties useful in directing into the formation 290, 295. Indeed, in one embodiment, the packers 160, 260 are outfitted with multiple transceivers and/or both sensors 101, 201 and transmitters.

So, for example, acoustic or other transmissions (e.g. 205) may be directed into the formation 290, 295 and sensed therefrom relative the same packer location.

Continuing with reference to FIG. 2, a host of surface equipment 225 is disposed at the surface of the oilfield 200. This includes a production line 257 running from a well head 255 in an embodiment where the packers 160, 260 are supported by production tubing 110 of the system. A rig 230 is even positioned over the well head 255 to support alternate monitoring or more directly interventional subsequent applications. However, more notably, a processing or control unit 250 is also disposed adjacent the well head 255.

The above noted unit 250 may be telemetrically coupled to the downhole sensors 101, 201 via the above described telemetric line 125. As such, data acquired by the sensors 101, 201 may ultimately be processed by the control unit 250 to establish downhole conditions such as those pertaining to the formation 290, 295. The line 125 may be supported externally by the tubing 110 of the system as depicted in FIG. 2. However, the line 125 may alternatively be incorporated into the tubing structure, for example, in combination with electrical or hydraulic downhole wetmate systems. Indeed, inductive coupling may even be utilized to allow the line 125 to alternately be incorporated into a casing or liner disposed at the well wall 285.

In an embodiment where the sensors 101, 201 are in the form of transceivers or substituted with transmitters, the control unit 250 may direct transmissions into the formation 290, 295 as indicated at 205, perhaps followed by analysis of detected information as a result of such transmissions. In one embodiment, the directing of such transmissions may even be intelligent. That is, such directing may be based in part on real-time or prior sensor acquired information.

Figure 3B:
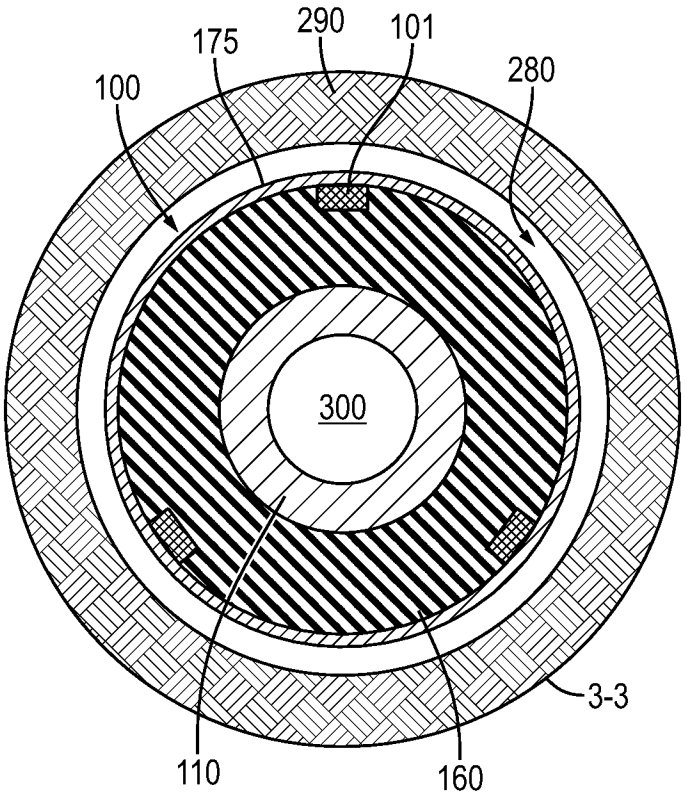
FIG. 3B is a cross-sectional view of the packer sensor assembly of FIG. 3A in an undeployed state.
Figure 3A:
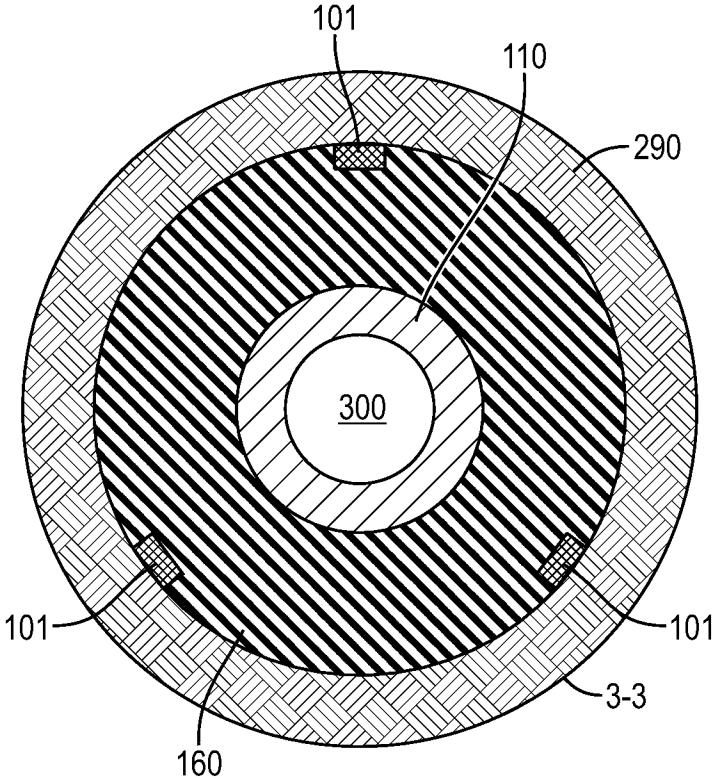
FIG. 3A is a cross-sectional view of the system taken from 3-3 of FIG. 2 and revealing the packer sensor assembly in a deployed state.

Referring now to FIG. 3A, a cross-sectional view of the system taken from 3-3 of FIG. 2 is shown. In this depiction, the packer 160 is shown in the same deployed state as that depicted in FIG. 2, with the sensors 101 forcibly disposed at the well wall 285. In the view of FIG. 3A, the protective jacket 175 (see FIG. 3B) is removed and the packer 160 swollen or otherwise expanded through mechanical, hydraulic or other means to the deployed state with the sensors 101 right at the formation 290 for data acquisition therefrom, or in the case of a transmitter, transmissions thereto. In this view, the support provided by the production tubing 110 to the packer 160 is also apparent, as is a production channel running through the tubing 110.

Referring now to FIG. 3B, a cross-sectional view of the system taken from 3-3 of FIG. 3A is also shown. However, in this depiction, the packer 160 is in an undeployed state with the protective jacket 175 in place about the packer 160 and sensors 101. That is, prior to deployment as shown in FIG. 3A, the protective jacket 175 remains for protection of the sensors 101. Indeed, with the jacket 175 in place and adequate clearance through the well 280, the system may be run from surface and into position as depicted in FIG. 2 without undue concern over damage to the sensors 101. Once in place, the jacket 175 may be removed via degradation or other means as noted hereinabove. Thus, deployment of the packer 160 as depicted in FIG. 3A may ensue.

Figure 4A:
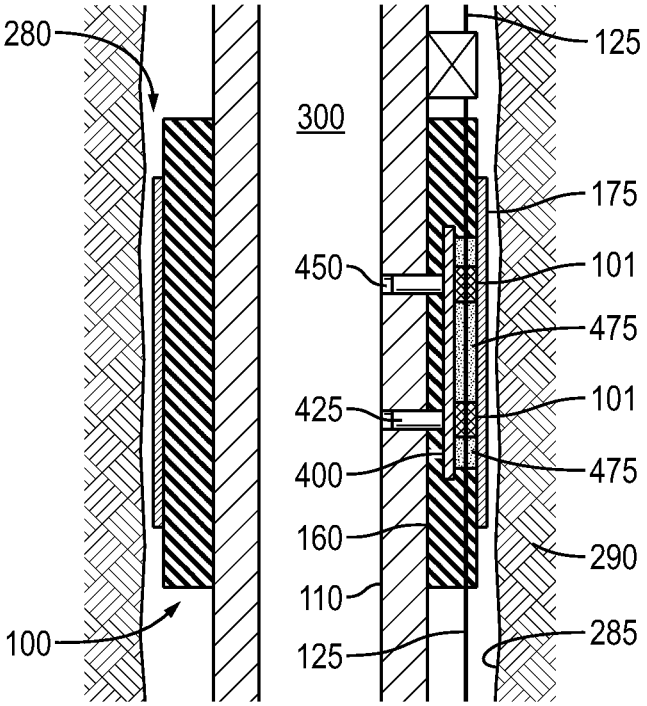
FIG. 4A is a side cross-sectional view of the packer sensor assembly in an undeployed state.

Referring now to FIG. 4A, a side cross-sectional view of the packer assembly 100 is shown in an undeployed state like that of FIG. 3B. In this cross-sectional view, added features are apparent, particularly those serving as an aid to deployment of the sensors 101. For example, the sensors 101 are apparent below the protective jacket 175 and disposed on a supportive platform 400. The platform 400 is in turn coupled to a force enhancing mechanism in the form of pistons 425 which are disposed in hydraulic chambers running through the packer 160 and tubing 110. Thus, the hydraulically driven platform 400 may serve as an aid in deployment of the sensors 101 into the face of the irregular open-hole well wall 285 as described further below. In an alternate embodiment, the pistons 425 are spring loaded as opposed to hydraulically driven. As such, removal of the protective jacket 175 may be sufficient to attain the enhanced forces supplied by the pistons 425 toward the sensors 101 and platform 400.

Continuing with reference to FIG. 4A, the sensors 101 are shown disposed in protective media 475. That is, space between the protective jacket 175 and the platform 400 that is not occupied by the sensors 101 or the telemetric line 125 may be filled with media 475 configured to protect the integrity of the sensors 101 and/or the data acquisition (or transmissions) thereby. For example, a noise insulating or shock absorbing polymeric compound may be utilized to enhance signal, particularly where the sensor 101 is acoustic in nature. Synthetic rubber, fluoropolymer elastomers and composite plastics may be suitable for such use. Additionally, the media 475 may also be a dielectric to ward off the possibility of short circuit. Polyaryl ether ketones, polyimides, polyphenyl sulfide, and ethylene or propylene copolymers may be suitable for such use along with xylylene polymers.

Figure 4B:
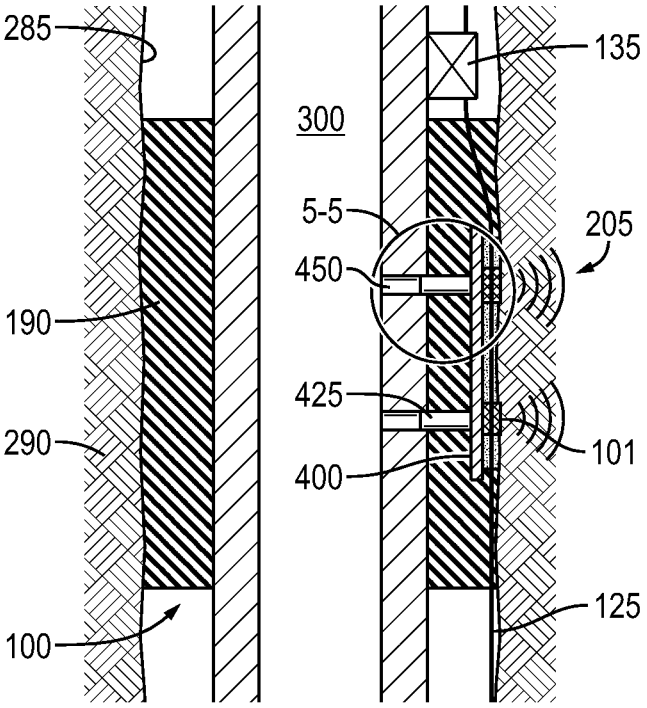
FIG. 4B is a side cross-sectional view of the packer sensor assembly in a deployed state.

Referring now to FIG. 4B, a side cross-sectional view of the packer sensor assembly 100 is shown in a deployed state with the protective jacket 175 of FIG. 4B removed. In this depiction the swollen nature of the packer 160 is evident, forcing the sensors 101 into the well wall 285. Furthermore, the amount of force imparted on the sensors 101 may be enhanced by the deployment of the above noted pistons 425 directed at the platform 400. In one embodiment, the pistons 425 may be of a ratcheted configuration. By way of example, the swell of the packer 160 may impart forces of up to a couple hundred PSI, whereas the enhanced force supplied by the pistons 425 may impart PSI forces in the thousands on the platform 400 and sensors 101. Indeed, as shown in FIG. 4B, the sensors 101 may actually penetrate the surface of the wall 285, embedding into the formation 290 to a degree.

In the embodiment of FIG. 4B, the sensors 101 are depicted as transceivers which are employed to emit transmissions 205 as described above. This may be a particularly effective detection technique given the substantially complete contact that is forcibly maintained between these transceivers 101 and the wall 285. That is to say, with such contact, transmissions 205 such as acoustics may readily propagate through the formation followed by a substantially interference-free detection, perhaps even by the same transceivers 101. Analysis of such detections, for example, at the control unit 250 of FIG. 2 may provide reliable information as to characteristics of the formation 290. Additionally, these, or any other detections made by the sensors 101 may be processed by the electronic subassembly 135 for relay uphole as described above.

Figure 5:
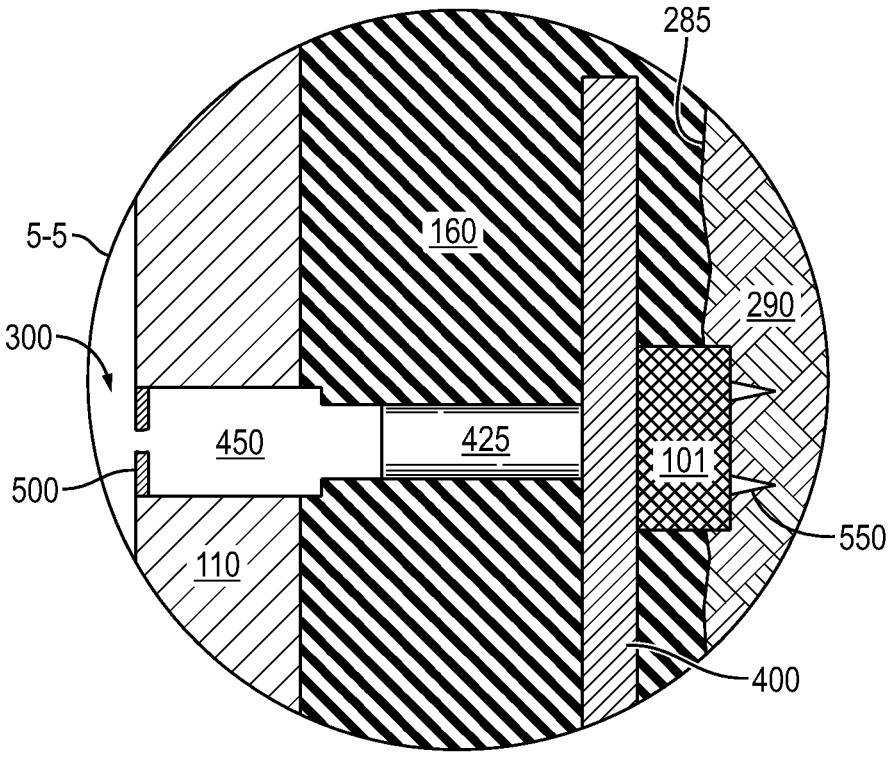
FIG. 5 is an enlarged view of a portion of the assembly taken from 5-5 of FIG. 4B and revealing the interface of a sensor of the assembly with a well wall.

Referring now to FIG. 5, an enlarged view of a portion of the assembly 100 taken from 5-5 of FIG. 4B is shown. In this view the interfacing of the sensor 101 with the well wall 285 is more apparent. Indeed, in the embodiment shown, the sensor 101 is outfitted with probes 550 for penetrating further into the formation 290. Thus, improved contact for detections, transmissions and/or grip may be provided. Additionally, the hydraulics of the piston 425 and chamber 450 are also accompanied by a rupture disk 500 which serves as a barrier to the channel 300 at the other side of the tubing 110. Thus, prior to piston deployment as shown in FIG. 5, pressure in the chamber 450 may be kept at a lower pre-deployment level. Subsequently, pressure in the channel 300 may be driven up to a level sufficient to rupture the disk 500 as shown in FIG. 5, thereby deploying the piston 425 and providing the noted enhanced forces on the platform 400 and sensor 101.

Figure 6:
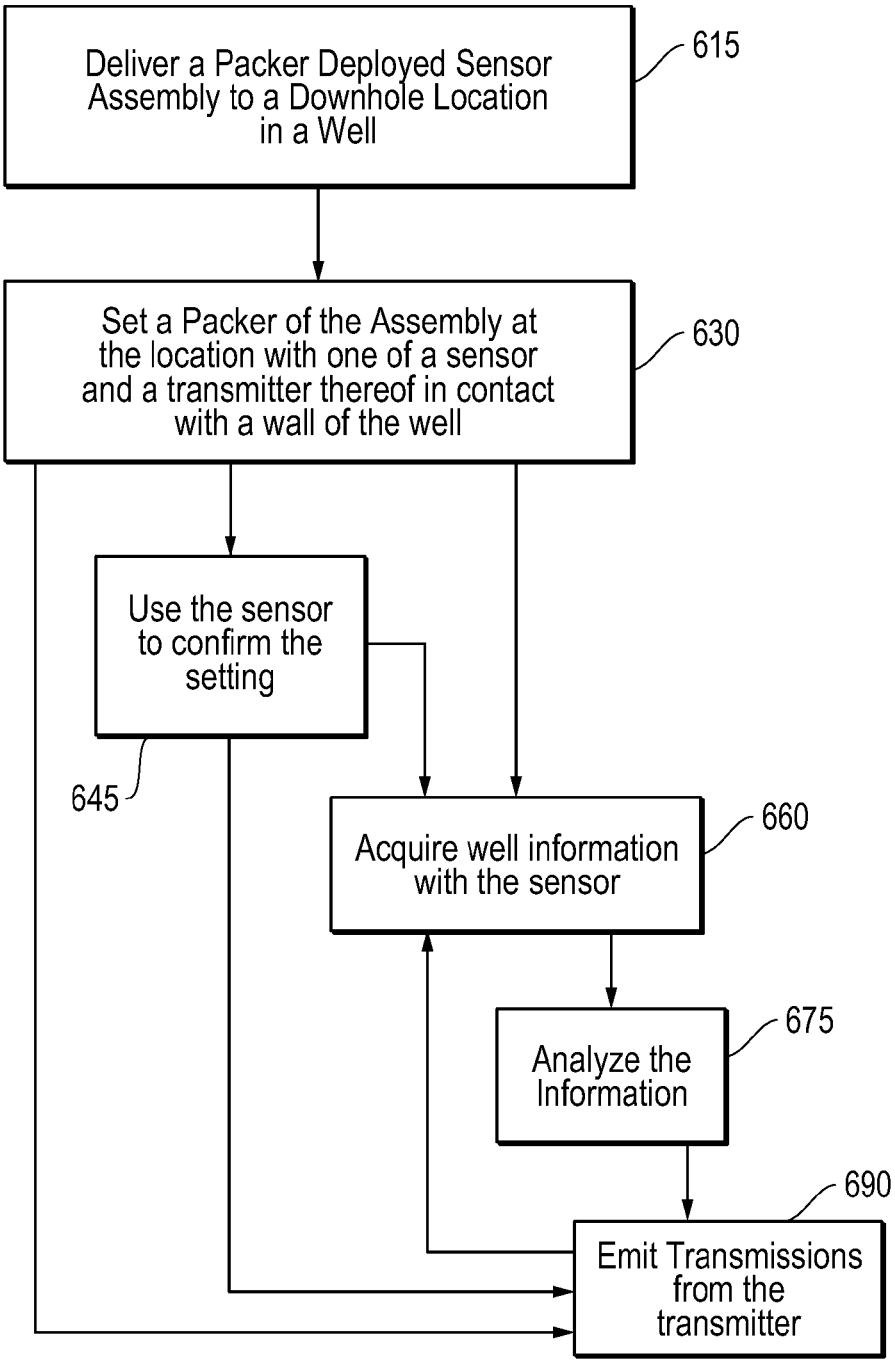
FIG. 6 is a flow-chart summarizing an embodiment of utilizing a packer deployed formation sensor.

Referring now to FIG. 6, a flow-chart is depicted summarizing an embodiment of utilizing a packer deployed formation sensor assembly. The assembly is delivered into a well and set as indicated at 615 and 630. This setting includes setting of a packer of the assembly as well as positioning a sensor and/or transmitter into interface with a wall of the well. In the case of a sensor, confirmation of the setting may be obtained as indicated at 645, for example where the sensor incorporates or is a strain gauge.

Perhaps more to the point, however, the assembly may be utilized to acquire well information directly from the wall of the well as indicated at 660. This information may be analyzed as indicated at 675, for example as an aid in building a profile of the well. Indeed, such information may even be beneficial in helping to build an overall profile of the formation. Furthermore, this information may be utilized in real-time, for example to direct the emission of transmissions into the formation for further analysis such as where the sensor is of a transceiver variety (see 690). Of course, such emissions may also take place irrespective of prior analysis.

Embodiments detailed hereinabove provide techniques for determining formation and other downhole information that is of enhanced reliability and accuracy. Further, such tools and techniques for acquiring such downhole data may be utilized in a manner that obviates the need for separately run logging or other dedicated data acquiring well interventions. Thus, in addition to improved results through the use of packer deployed sensors, the costs of attaining such information may be dramatically reduced. In fact, such tools and techniques may be particularly beneficial in supporting heretofore dramatically difficult and costly cross-well logging operations.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, sensor assemblies are detailed hereinabove as utilizing a telemetric line. However, emerging wireless power and/or communications technologies may similarly be utilized. Furthermore, the foregoing description should not be read as pertaining only to the precise structures described and shown in the accompanying drawings, but rather should be read as consistent with and as support for the following claims, which are to have their fullest and fairest scope.

We claim:

1. A packer for disposing in a well at an oilfield, the packer comprising:

- a swellable elastomer structure disposed about an under-support structure; and
- a sensor configured to sense a condition exterior to the packer;
- a transmitter configured to transmit energy into a wall of the well, wherein the sensor and transmitter are disposed at an outer surface of the elastomer structure for contacting the wall of the well upon swelling deployment thereof;
- a telemetry line from the sensor or transmitter to relay information back to the surface;
- a platform for accommodating the one of the sensor and the transmitter, the platform located at the outer surface and coupled to a force enhancing mechanism therebelow, wherein the force enhancing mechanism comprises one of a spring and a hydraulic assembly, wherein the hydraulic assembly comprises:
  - a hydraulic chamber with a piston disposed therein for driving the platform; and
  - a rupture disk isolating the chamber from a channel disposed through the under-support structure, the channel pressurizable for breaking the disk to enhance forces against the platform.

2. The packer of claim 1 wherein the one of the sensor and the transmitter further comprises at least one probe for penetrating into the wall during the contacting.

3. The packer of claim 1 wherein the one of the sensor and the transmitter is disposed in a protective media including a material selected from a group consisting of rubber, fluoropolymer elastomers, composite plastic and a dielectric.

4. The packer of claim 3 wherein the dielectric is one of a polyaryl ether ketone, a polyimide, polyphenyl sulfide, an ethylene copolymer, a propylene copolymer and a xylylene polymer.

5. The packer of claim 1 wherein the hydraulic assembly comprises a ratcheted piston.

* * * * *